US011357372B2

(12) United States Patent
Buening et al.

(10) Patent No.: US 11,357,372 B2
(45) Date of Patent: Jun. 14, 2022

(54) VACUUMED MATERIAL COLLECTION STATION, VACUUM CLEANING APPARATUS AND SYSTEM CONSISTING OF A VACUUMED MATERIAL COLLECTION STATION AND A VACUUM CLEANING APPARATUS

(71) Applicant: Vorwerk & Co. Interholding GmbH, Wuppertal (DE)

(72) Inventors: Thomas Buening, Bochum (DE); Benjamin Fleczok, Essen (DE); Robert Frielinghaus, Bochum (DE); Martin Helmich, Duisburg (DE); Lorenz Hillen, Wuppertal (DE); Christian Holz, Dortmund (DE); Gerhard Isenberg, Cologne (DE); Andrej Mosebach, Bochum (DE); Roman Ortmann, Duisburg (DE); Kevin Schmitz, Duesseldorf (DE); Fabian Vitz, Wuppertal (DE); Niklas Van Teeffelen, Duesseldorf (DE); Georg Hackert, Wilen bei Wollerau (CH)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 256 days.

(21) Appl. No.: 16/800,174

(22) Filed: Feb. 25, 2020

(65) Prior Publication Data

US 2020/0281427 A1 Sep. 10, 2020

(30) Foreign Application Priority Data

Mar. 8, 2019 (DE) ..... 10 2019 105 935.6

(51) Int. Cl.
*A47L 9/10* (2006.01)
*A47L 9/28* (2006.01)

(52) U.S. Cl.
CPC ..... *A47L 9/106* (2013.01); *A47L 9/2852* (2013.01); *A47L 9/2873* (2013.01); *A47L 2201/024* (2013.01)

(58) Field of Classification Search
CPC .. A47L 2201/024; A47L 9/106; A47L 9/2852; A47L 9/2873
See application file for complete search history.

(56) References Cited

U.S. PATENT DOCUMENTS 5,959,423 A * 9/1999 Nakanishi ..... A47L 11/4019 318/568.12
7,849,555 B2 * 12/2010 Hahm ..... A47L 9/1481 15/319
2005/0212478 A1 * 9/2005 Takenaka ..... A47L 9/2873 320/107

FOREIGN PATENT DOCUMENTS

EP 1 849 391 A2 10/2007
EP 1842474 A2 * 10/2007 ..... A47L 9/106
(Continued)

OTHER PUBLICATIONS

KR-20100010064-A—English Machine Translation (Year: 2010).*

*Primary Examiner* — Marc Carlson
(74) *Attorney, Agent, or Firm* — Collard & Roe, P.C.

(57) ABSTRACT

A vacuumed material collection station for receiving vacuumed material from a vacuum cleaning apparatus includes a vacuumed material collection container and an interface for connecting the vacuum cleaning apparatus to the vacuumed material collection station. The vacuumed material collection station comprises a receptacle space for receiving a filter chamber of a vacuum cleaning apparatus connected to the vacuumed material collection station and a feed device for feeding the filter chamber into the receptacle space. The receptacle space is designed for completely encompassing the filter chamber and/or at the most not encompassing a
(Continued)

chamber side facing the interface with the vacuum cleaning apparatus. The receptacle space forms a partial volume within the housing of the vacuumed material collection station, and the feed device is designed for removing the filter chamber from the vacuum cleaning apparatus and displacing the filter chamber into the receptacle space.

8 Claims, 4 Drawing Sheets

(56) References Cited

FOREIGN PATENT DOCUMENTS

| | | | | | |
|---|---|---|---|---|---|
| EP | 1849391 | A2 | * | 10/2007 | ..... A47L 9/106 |
| KR | 20100010064 | A | * | 2/2010 | |

* cited by examiner

VACUUMED MATERIAL COLLECTION STATION, VACUUM CLEANING APPARATUS AND SYSTEM CONSISTING OF A VACUUMED MATERIAL COLLECTION STATION AND A VACUUM CLEANING APPARATUS

CROSS REFERENCE TO RELATED APPLICATIONS

Applicant claims priority under 35 U.S.C. § 119 of German Application No. 10 2019 105 935.6 filed Mar. 8, 2019, the disclosure of which is incorporated by reference.

BACKGROUND OF THE INVENTION

1. Field of the Invention

The invention pertains to a vacuumed material collection station for receiving vacuumed material from a vacuum cleaning apparatus, wherein the vacuumed material collection station comprises a vacuumed material collection container and an interface for connecting the vacuum cleaning apparatus to the vacuumed material collection station.

The invention furthermore also pertains to a system consisting of a vacuumed material collection station and a vacuum cleaning apparatus with a housing, a suction nozzle, a filter chamber, a fan and an electric motor for driving the fan.

2. Description of the Related Art

Vacuumed material collection stations and vacuum cleaning apparatuses are known from the prior art.

The vacuumed material collection stations serve for receiving vacuumed material such that the filter chamber of a vacuum cleaning apparatus containing vacuumed material can be emptied at the vacuumed material collection station. For this purpose, the vacuum cleaning apparatus preferably is connected to the vacuumed material collection station in a dust-tight manner such that the vacuumed material can be transferred into the vacuumed material collection container of the vacuumed material collection station without contamination of the ambient air.

Publications EP 1 849 391 A2 and U.S. Pat. No. 7,849,555 B2 respectively disclose a robotic cleaning system with a cleaning robot and a docking station for the cleaning robot. The cleaning robot comprises a dust collection container, which can be exchanged for another dust collection container by means of the docking station. A dust collection container filled with vacuumed material can be emptied in the docking station, wherein the vacuumed material is transferred into a collection container of the docking station.

Publication US 2005/0212478 A1 likewise discloses a system consisting of a cleaning apparatus and a base station, wherein a collection container of the cleaning apparatus can be exchanged by means of a rotary mechanism of the base station. The filled collection container received from the cleaning apparatus can be emptied in the base station.

SUMMARY OF THE INVENTION

Based on the aforementioned the prior art, the invention aims to develop an alternative vacuumed material collection station for cleaning a filter chamber of a cleaning apparatus, wherein the invention primarily focuses, in particular, on a disposal of the vacuumed material without contamination of the ambient air and/or excessive noise pollution by a fan operating in the vacuumed material collection station.

In order to attain the above-defined objective, it is proposed that the vacuumed material collection station comprises a receptacle space for receiving a filter chamber of a vacuum cleaning apparatus connected to the vacuumed material collection station and a feed device for feeding the filter chamber into the receptacle space, wherein the receptacle space is designed for completely encompassing the filter chamber and/or at the most not encompassing a chamber side facing the interface with the vacuum cleaning apparatus, wherein the receptacle space forms a partial volume within the housing of the vacuumed material collection station, and wherein the feed device is designed for removing the filter chamber from the vacuum cleaning apparatus and displacing the filter chamber into the receptacle space.

According to the invention, the vacuumed material collection station preferably is designed for completely receiving the filter chamber of the vacuum cleaning apparatus in the vacuumed material collection station. The receptacle space of the vacuumed material collection station preferably is realized such that its shape corresponds to a filter chamber of a vacuum cleaning apparatus, which should be inserted into the vacuumed material collection station. The receptacle space forms a partial volume within the housing of the vacuumed material collection station, wherein said partial volume is sufficiently large for completely encompassing the filter chamber of the vacuum cleaning apparatus in such a way that an outer contour of the filter chamber lies completely within or at least on the outer contour of the housing of the vacuumed material collection station. In this case, the receptacle space borders on the interface of the vacuumed material collection station, for example with one receptacle space side. Only the chamber side of the filter chamber facing the vacuum cleaning apparatus is accessible when the filter chamber is properly received in the receptacle space of the vacuumed material collection station. The remaining chamber sides of the filter chamber lie within the vacuumed material collection station and are not visible from outside. In case of a cuboid filter chamber, this means that only one of altogether six sides is not covered by the housing of the vacuumed material collection station, namely by the walls of the receptacle space. The complete insertion of the filter chamber of the vacuum cleaning apparatus into the vacuumed material collection station makes it possible to ensure a low-noise and dust-free transfer of the vacuumed material from the vacuum cleaning apparatus into the vacuumed material collection station. After the filter chamber has been transferred into the receptacle space of the vacuumed material collection station, the vacuum cleaning apparatus may remain connected to the interface or alternatively move away from the vacuumed material collection station. If the vacuum cleaning apparatus remains connected to the interface, it is not necessary to close the housing of the vacuumed material collection station in the region of the interface in order to ensure that dust and dirt present in the filter chamber or the receptacle space cannot reach the surroundings. If the vacuum cleaning apparatus moves away from the vacuumed material collection station, it may be desirable or due to a noise emission advisable to respectively close the housing of the vacuumed material collection station or the receptacle space in the region of the interface. It would be conceivable to respectively close the receptacle space and/or the housing of the vacuumed material collection station with a closure element in the region of the interface such that the filter chamber received in the receptacle space is enclosed on all sides. According to this embodiment, vacuumed material cannot reach the ambient air. Furthermore, this embodiment allows particularly quiet cleaning of the filter chamber by means of the vacuumed material collection station, for example, because a fan or mechanical devices used for cleaning the filter chamber are less noticeable. In any case, it is proposed that the opening of the vacuumed material collection station is closed in the region of the interface by at least one chamber side of the filter chamber inserted into the receptacle space. This chamber side may be sealed relative to the walls of the receptacle space and/or the housing of the vacuumed material collection station with the aid of sealing elements such that vacuumed material remains within the receptacle space and cannot escape into the surroundings through a gap that may potentially be formed between the filter chamber and the receptacle space.

The receptacle space of the vacuumed material collection station preferably is closed in the region of the interface by a closure element in a non-use position, i.e. when the base station is not required for a service activity. This closure element may be realized, for example, in the form of a displaceable element such as a pivotable flap or a sliding element. The same applies to the vacuum cleaning apparatus, the housing of which is likewise closed during a normal vacuum cleaning operation such that the filter chamber is not visible from outside. The closure elements of the vacuum cleaning apparatus and the vacuumed material collection station are not opened until the vacuum cleaning apparatus is connected to the vacuumed material collection station such that the filter chamber of the vacuum cleaning apparatus can be transferred into the receptacle space of the vacuumed material collection station via the interface. The closure elements can be actuated manually by a user or alternatively also automatically when a cleaning request with respect to a filter chamber is detected. A transfer request may be communicated, for example, due to a mechanical contact of the vacuum cleaning apparatus with the vacuumed material collection station. For example, the vacuumed material collection station may comprise a contact switch that causes the closure element of the interface to open when docking of a vacuum cleaning apparatus takes place. In this case, it is irrelevant whether the vacuum cleaning apparatus is a robotic vacuum cleaning apparatus that autonomously travels to the vacuumed material collection station or a vacuum cleaning apparatus that is manually connected to the vacuumed material collection station by a user. Opening mechanisms other than contact switches would also be conceivable, for example, by using light barriers, radio signals or the like.

The feed device of the vacuumed material collection station is designed for removing the filter chamber from the vacuum cleaning apparatus and displacing the filter chamber into the receptacle space. The feed device preferably extends out of the housing of the vacuumed material collection station in the direction of the vacuum cleaning apparatus such that the filter chamber can be received. For example, the feed device may comprise a gripping device for taking hold of the filter chamber. Such a gripping device may be realized, for example, in the form of a hook element, a catch element or the like. The connecting element preferably can be displaced by a motor such that the process of taking hold of and once again releasing the filter chamber can also take place in an automated manner. A displacement of the guiding device preferably can also take place simultaneously with a displacement of the feed device in the direction of the vacuum cleaning apparatus such that the filter chamber to be displaced also comes in direct contact with the guiding device and is directly subjected to a guided displacement motion. As soon as the filter chamber has been emptied in the vacuumed material collection station, the feed device carries out a motion in the opposite direction, i.e. from the receptacle space in the direction of the vacuum cleaning apparatus. Since the vacuumed material collection station is realized with a feed device, it is not necessary that the vacuum cleaning apparatus comprises the device or a mechanism for displacing the filter chamber out of the vacuum cleaning apparatus in the direction of the vacuumed material collection station. The vacuum cleaning apparatus therefore may be realized passively in this respect.

It is furthermore proposed that the feed device comprises a guiding device for guiding a displacement motion of the filter chamber into the receptacle space and/or a driving device for displacing the filter chamber. The guiding device serves for aligning and guiding the filter chamber during the displacement from the vacuum cleaning apparatus into the receptacle space of the vacuumed material collection station. In this way, the displacement motion has a defined direction and the filter chamber can be prevented from tilting on its way into the receptacle space and thereby from assuming an improper position within the receptacle space. For example, the guiding device may be realized in the form of a slotted guide. The slotted guide particularly may be formed by walls of the receptacle space and optionally also comprise additionally guide braces or the like. The guiding device may furthermore comprise a guide rail. For example, the guide rail may extend from the interface of the vacuumed material collection station up to or completely into the receptacle space. In addition, the guiding device may also comprise a guide spindle. The guide spindle preferably is driven by a motor such that the rotation of the guide spindle simultaneously causes a guided displacement of the filter chamber into the receptacle space.

The feed device may furthermore comprise a driving device for displacing the filter chamber. Such a driving device particularly may comprise an electric motor and/or a spring element. The driving device preferably is combined with the guiding device of the feed device, e.g. with the above-proposed guide rail or guide spindle. Consequently, a preferred combination in the sense of an automated, guided displacement motion of the filter chamber is realized.

It is furthermore proposed that the receptacle space of the vacuumed material collection station is arranged above the vacuumed material collection container referred to a normal operative orientation of the vacuumed material collection station such that vacuumed material can drop from a filter chamber arranged in the receptacle space into the vacuumed material collection container under the influence of the gravitational force. According to this embodiment, it is not necessary, but nevertheless possible, to use a fan or mechanical cleaning elements for emptying the filter chamber. In fact, the gravitational force acting upon the vacuumed material alone can suffice for causing the vacuumed material to drop from the filter chamber located in the receptacle space into the vacuumed material collection container located thereunder. It is accordingly important that an opening of the receptacle space and a corresponding opening of the vacuumed material collection container are arranged on top of one another referred to a vertical direction. The filter chamber of the vacuum cleaning apparatus accordingly is inserted into the receptacle space in such a way that an opening of the filter chamber is arranged congruently or at least partially overlaps the opening of the receptacle space and the opening of the vacuumed material collection container.

The receptacle space may additionally or alternatively be arranged in an air flow channel of the vacuumed material collection station. The air flow channel of the vacuumed material collection station can be connected to a fan of the vacuumed material collection station or to an external fan, e.g. the fan of a vacuum cleaning apparatus. The air flow guided in the air flow channel penetrates the receptacle space such that a vacuum is generated therein, wherein said vacuum transports the vacuumed material out of the filter chamber arranged in the receptacle space. In this case, the fan preferably is connected to the air flow channel in such a way that the flow direction corresponds to a transport direction of the vacuumed material from the receptacle space into the vacuumed material collection space of the vacuumed material collection station. The above-proposed gravitational force effect can assist in the transport of the vacuumed material by means of the air flow.

It is furthermore proposed that a station fan is associated with the air flow channel, wherein the station fan is designed for generating a vacuum in the receptacle space. According to this embodiment, the vacuumed material collection station itself comprises a station fan for respectively removing vacuumed material from the receptacle space or the filter chamber arranged therein. The noises of the station fan, which are potentially noticeable from outside, are reliably reduced due to the fact that the receptacle space completely encloses the filter chamber.

According to a special embodiment, the air flow channel of the vacuumed material collection station may respectively comprise a pressure sensor upstream and downstream of the receptacle space referred to the flow direction. The pressure sensors make it possible to measure a pressure loss across the filter chamber, which is a measure for the filling level of the filter chamber with vacuumed material. The power of the fan/station fan can then be controlled in dependence on the information on the quantity of vacuumed material located in the filter chamber. In this way, the fan can be controlled in dependence on the respective situation such that only the suction power required for optimally removing the vacuumed material from the filter chamber is applied. This additionally reduces the noises emitted by the fan. For example, a relatively high suction power of the fan can be adjusted if the pressure sensors measure a relatively high pressure loss across the filter chamber. A correspondingly reduced suction power is used for the cleaning operation if it is determined that the quantity of vacuumed material contained in the filter chamber is rather low. Furthermore, a point in time of an operation of the fan can be controlled in dependence on the determined pressure loss. For example, the fan may not be turned on until it is actually required. An inconspicuous, quiet and usage-controlled regeneration of the filter chamber therefore takes place in the vacuumed material collection station.

The invention ultimately also pertains to a system consisting of a proposed vacuumed material collection station and a vacuum cleaning apparatus with a housing, a suction nozzle, a filter chamber, a fan and an electric motor for driving the fan, wherein the feed device of the vacuumed material collection station is designed for removing the filter chamber from the vacuum cleaning apparatus and displacing the filter chamber into the receptacle space and/or wherein the vacuum cleaning apparatus comprises a displacement device that is designed for displacing the filter chamber out of the housing of the vacuum cleaning apparatus, and wherein the vacuum cleaning apparatus can be arranged on the interface of the vacuumed material collection station in such a way that the receptacle space of the vacuumed material collection station and a portion of the vacuum cleaning apparatus containing the filter chamber are connected to one another. The system therefore comprises a vacuumed material collection station and a vacuum cleaning apparatus that preferably are realized in accordance to an above-described embodiment. In this case, either the vacuumed material collection station or the vacuum cleaning apparatus of the system may comprise a mechanism for displacing a filter chamber from the vacuum cleaning apparatus into the receptacle space of the vacuumed material collection station. Furthermore, the vacuumed material collection station and the vacuum cleaning apparatus are designed so as to correspond to one another in such a way that a housing opening of the vacuum cleaning apparatus is arranged congruently with the interface of the vacuumed material collection station in a docked state of the vacuum cleaning apparatus with the interface of the vacuumed material collection station. It is proposed that corresponding housing openings of the vacuumed material collection station and the vacuum cleaning apparatus at least overlap one another in such a way that the filter chamber can be transferred from the vacuum cleaning apparatus into the receptacle space of the vacuumed material collection station in an unobstructed manner. The advantages and characteristics described above with reference to the vacuumed material collection station and optionally the vacuum cleaning apparatus apply accordingly to the inventive system. We therefore refer to the preceding explanations in order to avoid unnecessary repetitions.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
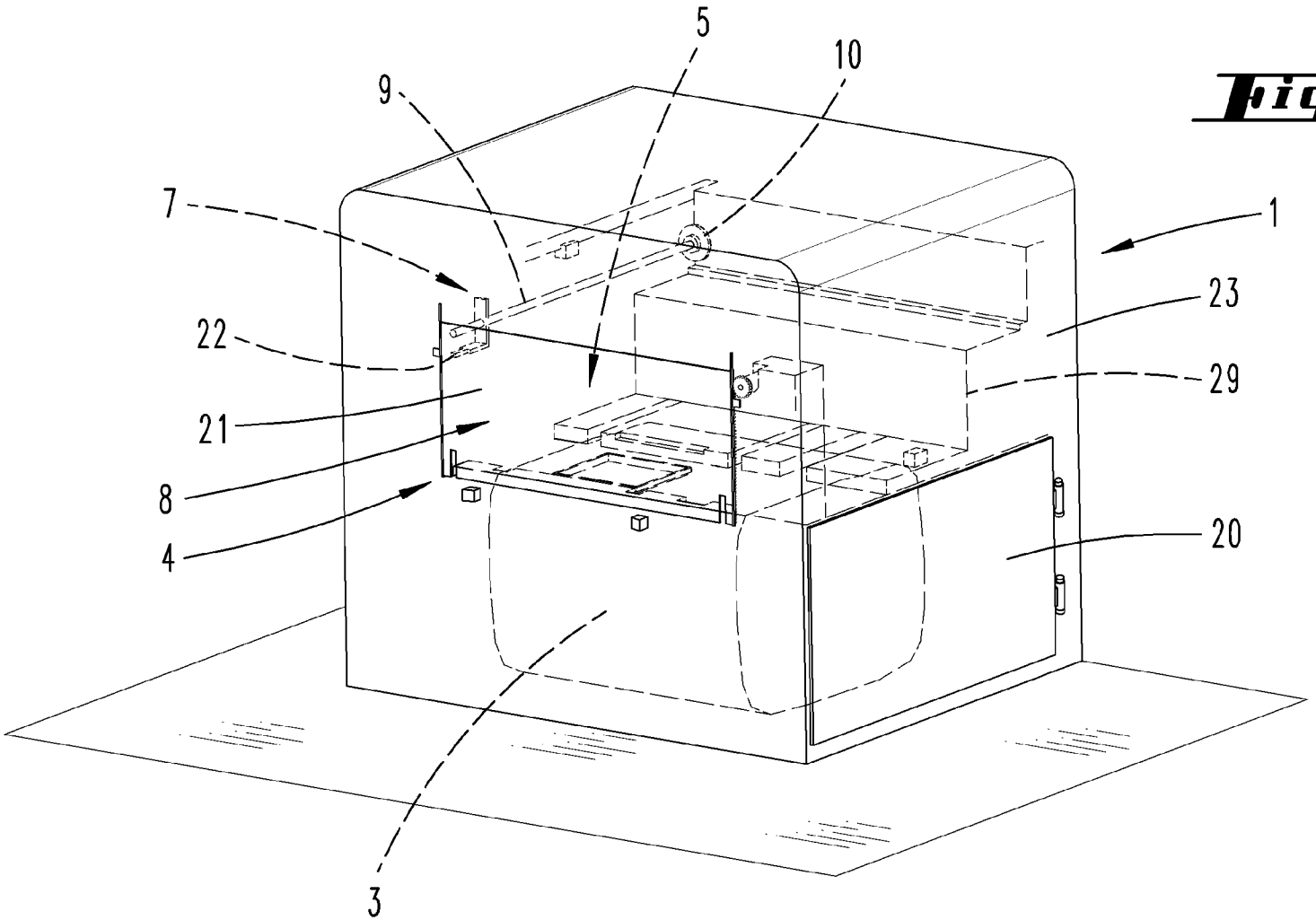
FIG. 1 shows an inventive vacuumed material collection station.

FIG. 1 shows an example of a potential embodiment of an inventive vacuumed material collection station 1. In this case, the vacuumed material collection station 1 serves as a docking station for a vacuum cleaning apparatus 2 that is illustrated in greater detail in FIG. 2 and realized in the form of an autonomously traveling robot. Viewed from outside, the vacuumed material collection station 1 comprises a station housing 23 with an interface 4 for connecting the vacuum cleaning apparatus 2. The interface 4 comprises a closure element 21, in this case a sliding element that can be displaced upward and closes a chamber side 8 in a state, in which the vacuumed material collection station 1 is not in use. When the chamber side 8 is opened, the interface 4 provides a view into a receptacle space 5 that serves for receiving a filter chamber 6 (see FIG. 2) of the vacuum cleaning apparatus 2. The receptacle space 5 comprises a feed device 7 with a guiding device 9 in the form of a spindle and a driving device 10. In this case, the driving device 10 is realized in the form of an electric motor. The guiding device 9 furthermore comprises a connecting element 22 that serves for taking hold of the filter chamber 6. In this case, the connecting element 22 is realized in the form of a catch element that can engage into a corresponding element of the filter chamber 6. The feed device 7 preferably comprises two guiding devices 9. The connecting elements 22 and the drive device 10 are located on opposite end regions of the guiding device 9. The station housing 23 has a collection container access 20 that allows access to a vacuumed material collection container 3 in an opened state.

Figure 2:
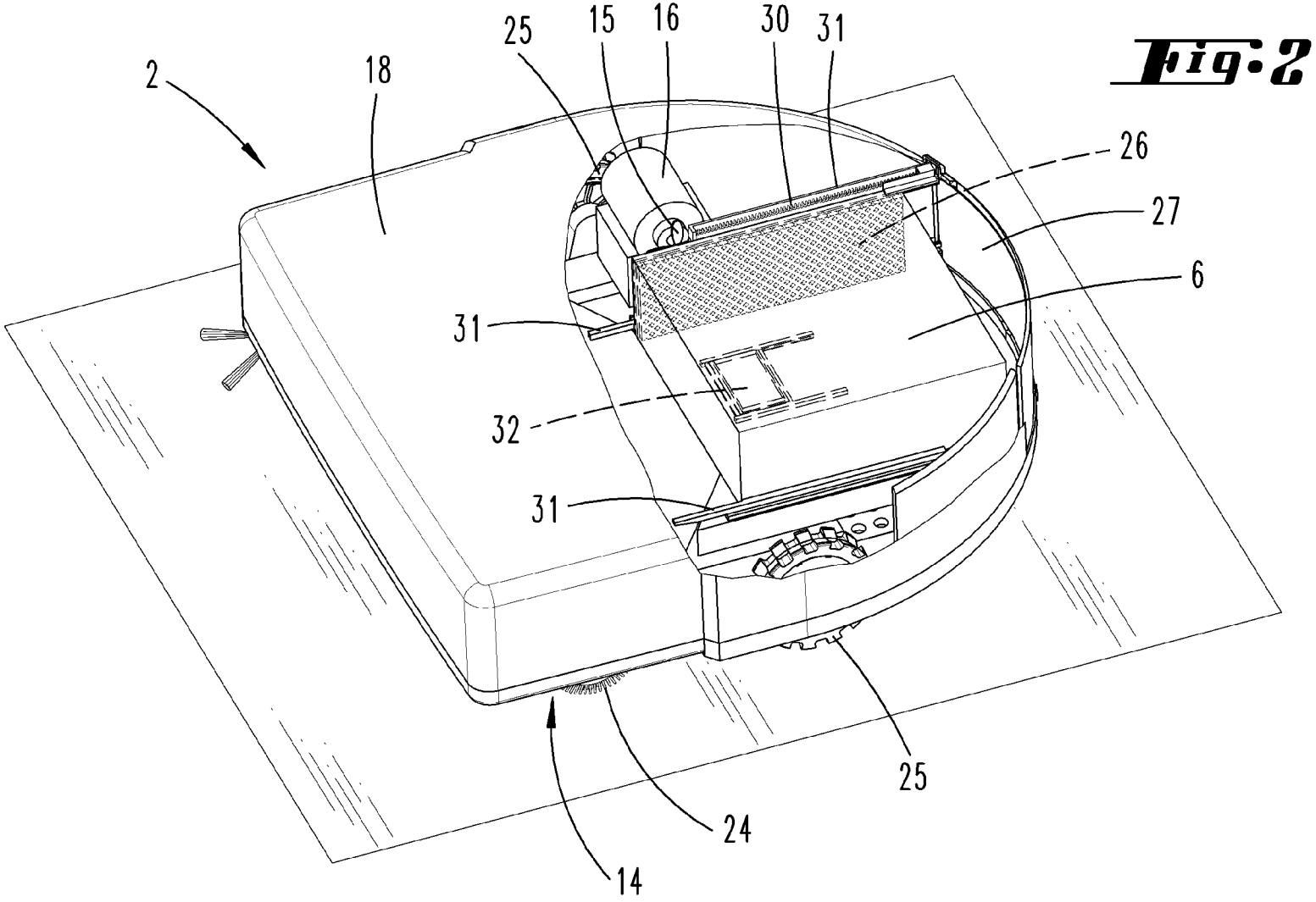
FIG. 2 shows a vacuum cleaning apparatus.

FIG. 2 shows a vacuum cleaning apparatus 2 that is realized in the form of an autonomously traveling robot in this case. The vacuum cleaning apparatus 2 comprises a housing 18 with a closure element 27, a suction nozzle 14, a filter chamber 6 with a filter element 26 and a filter chamber closure element 32, a fan 15 and an electric motor 16 for driving the fan 15. The filter chamber 6 is displaceably supported on guiding devices 31 and can be displaced out of the housing 18 of the vacuum cleaning apparatus 2—under the influence of the restoring force of a spring element 30—when the closure element 27 is opened. A cleaning element 24 is associated with the suction nozzle 14 and in this case realized in the form of a rotating brush, which rotates about an essentially horizontal axis. The vacuum cleaning apparatus 2 furthermore comprises wheels 25 for driving the vacuum cleaning apparatus 2, as well as a navigation device that is not illustrated in greater detail in this figure and serves for the navigation and self-localization of the vacuum cleaning apparatus 2 within an environment. Sensors (likewise not illustrated) are advantageously associated with the navigation device and capable, for example, of measuring distances from obstacles. The navigation device can generate an environment map based on the determined distances and the vacuum cleaning apparatus 2 can orient and self-localize itself within the environment with the aid of said environment map.

During a normal vacuuming operation, the vacuum cleaning apparatus 2 functions in such a way that the electric motor 16 drives the fan 15 in order to generate a vacuum, which opens the filter chamber closure element 32 and sucks vacuumed material from a surface to be cleaned into the filter chamber 6. Vacuumed material contained in the air being sucked in respectively remains in the filter chamber 6 or on the filter element 26 such that only cleaned air can flow onward to the fan 15 and the electric motor 16.

Figure 3:
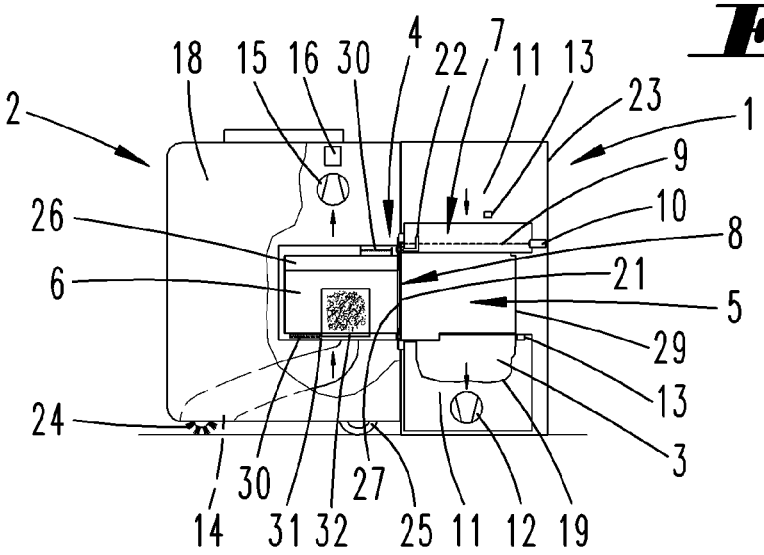
FIG. 3 shows a longitudinal section through a system consisting of a vacuumed material collection station and a vacuum cleaning apparatus with a filter chamber.

FIG. 3 shows an example of a system consisting of a vacuum cleaning apparatus 2 and an exemplary vacuumed material collection station 1. The vacuum cleaning apparatus 2 is docked with the vacuumed material collection station 1, wherein this may be achieved by providing not-shown devices that prevent an unintentional position change of the vacuum cleaning apparatus 2 and ensure that the position of the vacuum cleaning apparatus 2 relative to the vacuumed material collection station 1 does not change during the transfer of the filter chamber 6 to the vacuumed material collection station 1. This figure shows that the vacuumed material collection station 1 also comprises a vacuumed material collection container 3 in the form of a filter bag 19, which serves for receiving vacuumed material from the filter chamber 6, in addition to the receptacle space 5. The vacuumed material collection station 1 furthermore comprises a station fan 12 that is arranged in an air flow channel 11 in this case, wherein said air flow channel is acted upon with a vacuum by means of the station fan 12. During the operation of the station fan 12, the receptacle space 5 is acted upon with a vacuum such that air flows from the direction of the receptacle space 5 toward the station fan 12. The vacuumed material present in the air being sucked in is collected within the filter bag 19 such that only cleaned air can flow onward to the station fan 12.

Figure 4:
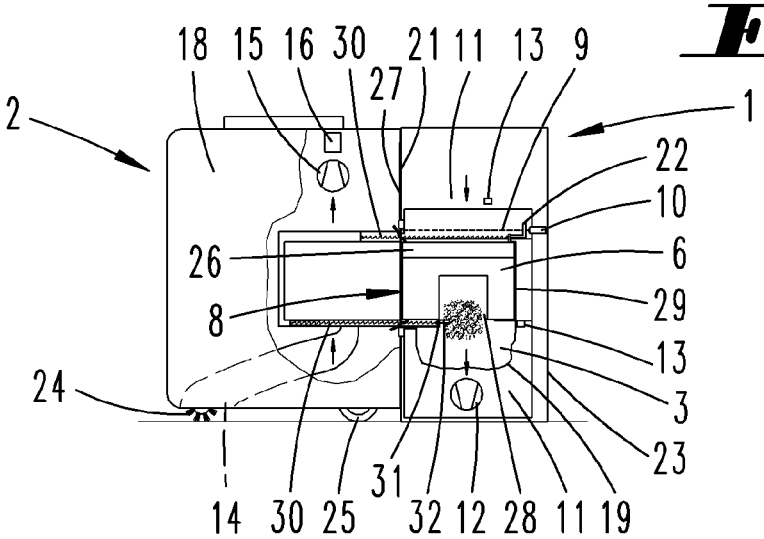
FIG. 4 shows the system according to FIG. 3 during a displacement of the filter chamber of the vacuum cleaning apparatus into the vacuumed material collection station.
Figure 5:
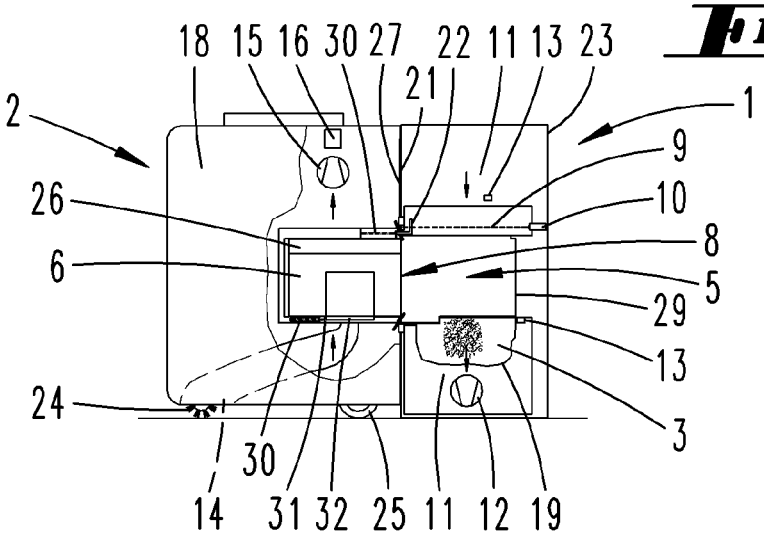
FIG. 5 shows the system according to FIGS. 3 and 4 after the filter chamber of the vacuum cleaning apparatus has been emptied.

The function of the system consisting of the vacuumed material collection station 1 and the vacuum cleaning apparatus 2 connected thereto is described in greater detail below with reference to FIGS. 3 to 5.

The vacuum cleaning apparatus 2 initially docks with the interface 4 of the vacuumed material collection station 1 as described above. In the process, the closure elements 21 and 27 of the vacuumed material collection station 1 and the vacuum cleaning apparatus 2 are opened, for example by means of contact switches, such that the filter chamber 6 of the vacuum cleaning apparatus 2 can be transferred into the receptacle space 5 of the vacuumed material collection station 1. The filter chamber 6 is pushed out of the housing 18 of the vacuum cleaning apparatus 2 by the restoring force of the spring element 30 of the vacuum cleaning apparatus 2 until the filter chamber 6 comes in contact with the connecting element 22 of the vacuumed material collection station 1. For example, corresponding catch elements of the feed device 7 of the vacuumed material collection station 1 and the filter chamber 6 may engage with one another. The driving device 10 in the form of an electric motor 16 is subsequently activated in order to drive the guiding device 9, namely the spindle in this case. In this way, the connecting elements 22 arranged on the spindle are displaced from the vacuum cleaning apparatus 2 into the receptacle space 5 together with the filter chamber 6 fastened thereon until the filter chamber 6 abuts on a limit stop 29 of the receptacle space 5. The position of the filter chamber 6 on the limit stop 29 is illustrated in FIG. 4. The abutment of the filter chamber 6 on the limit stop 29 can control the operation of the station fan 23 such that the receptacle space 5 and the filter chamber 6 located therein are respectively acted upon with a vacuum. The filter chamber closure element 32 may likewise be opened in this way. Vacuumed material located in the filter chamber 6 is transported into the filter bag 19 of the vacuumed material collection container 3 through the filter chamber opening 28. In the normal orientation of the vacuumed material collection station 1, the receptacle space 5 furthermore is arranged above the vacuumed material collection container 3 such that vacuumed material also drops down, i.e. in the direction of the vacuumed material collection container 3, with the assistance of the gravitational force acting thereupon. According to another embodiment, the transfer of the vacuumed material may take place entirely without the station fan 12, namely due to the displacement of the vacuumed material caused by the gravitational force only. The noises occurring during the operation of the station fan 12 only are slightly noticeable by a user in the surroundings outside the vacuumed material collection station 1 because the receptacle space 5 of the vacuumed material collection station 1 completely surrounds the filter chamber 6 except for the chamber side 8 pointing in the direction of the vacuum cleaning apparatus 2 and the chamber side 8 furthermore is covered by the vacuum cleaning apparatus 2 docked with the interface 4. However, it would also be possible that the chamber side 8 is once again closed by the closure element 21 of the receptacle space 5 before the filter chamber 6 is emptied. In any case, it is ensured that vacuumed material being displaced out of the filter chamber 6 cannot reach the surroundings through the interface 4.

In order to additionally reduce the noise pollution occurring when the filter chamber is emptied by means of the station fan 12, the filter chamber 6 may not be emptied by means of the station fan 12 until a user is no longer present in the surroundings of the vacuumed material collection station 1. In addition, a pressure loss across the filter chamber 6 including the filter element 26 can be measured with the aid of pressure sensors 13 that are arranged in the air flow channel 11 of the vacuumed material collection station 1 upstream and downstream of the receptacle space 5. If the pressure sensors 13 measure a relatively high pressure loss (in comparison with a reference value), for example, the filter chamber 6 may be immediately cleaned by means of the station fan 12. However, if the pressure loss is relatively low, the operation of the station fan 12 may be initially registered and not take place until the user is no longer present.

After the vacuumed material has been transferred from the filter chamber 6 into the filter bag 19 of the vacuumed material collection container 3, the guiding device 9 is moved in the opposite direction by means of the driving device 10, i.e. the spindle is moved in the opposite direction by means of the electric motor 16, such that the connecting elements 22 with the filter chamber 6 arranged thereon are displaced from the receptacle space 5 in the direction of the vacuum cleaning apparatus 2 through the interface 4. The filter chamber 6 is thereby once again completely displaced into the housing 18 of the vacuum cleaning apparatus 2 in the opposite direction until it has reached its end position. The closure elements 21, 27 of the vacuumed material collection station 1 and the vacuum cleaning apparatus 2 are then closed again and the vacuum cleaning apparatus 2 is available for another vacuuming operation. Once the filter chamber 6 has been cleaned, the vacuum cleaning apparatus 2 is in the ready-for-use position after the situation illustrated in FIG. 5.

Figure 6:
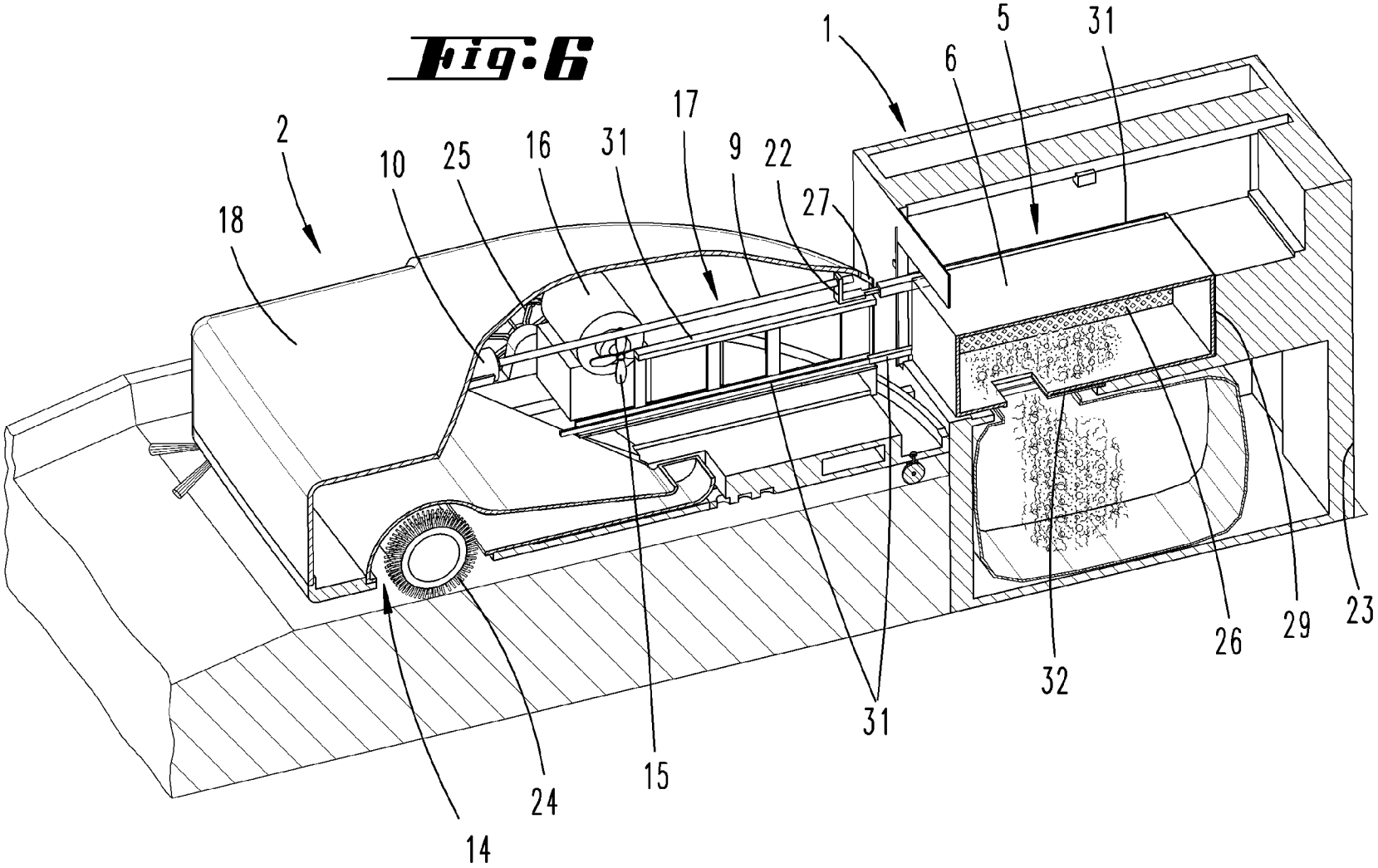
FIG. 6 shows an alternative embodiment of a system consisting of a vacuumed material collection station and a vacuum cleaning apparatus.

FIG. 6 shows another embodiment of an inventive vacuum cleaning apparatus 2 in the form of a sectional view. The vacuum cleaning apparatus 2 illustrated in this figure comprises its own displacement device 17 that can displace the filter chamber 6 out of the housing 18 of the vacuum cleaning apparatus 2. In this case, the displacement device 17 consists, for example, of a driving device 10 and a guiding device 9 (spindle), which is displaced out of the vacuum cleaning apparatus 2 when the vacuum cleaning apparatus 2 comes in contact with the interface 4 of the vacuumed material collection station 1. Furthermore, guiding devices 31 in the form of rail elements, along which the filter chamber 6 can slide, are associated with the displacement device 17 in this case.

The displacement device 17 may alternatively or additionally also comprise a spring element 30 (see FIG. 2). A release of the tensioned spring element 30 may be triggered automatically when the vacuum cleaning apparatus 2 comes in contact with the vacuumed material collection station 1. In the process, a not-shown restraint system such as a catch mechanism in the vacuum cleaning apparatus 2 is released such that the spring element 30 can press the filter chamber 6 into the vacuumed material collection station 1. In this case, the spring element 30 displaces the filter chamber 6 at least so far that the filter chamber 6 comes in contact, for example, with connecting elements 22 of a feed device 7 of the vacuumed material collection station 1 and the displacement motion therefore can be continued by the driving device 10 of the vacuumed material collection station 1. However, the filter chamber 6 may alternatively also be displaced up to the limit stop 29 of the vacuumed material collection station 1 by means of the displacement device 17 of the vacuum cleaning apparatus 2 only such that the vacuumed material collection station 1 itself does not have to comprise a feed device 7.

Although only a few embodiments of the present invention have been shown and described, it is to be understood that many changes and modifications may be made thereunto without departing from the spirit and scope of the invention.

LIST OF REFERENCE SYMBOLS

1 Vacuumed material collection station
2 Vacuum cleaning apparatus
3 Vacuumed material collection container
4 Interface
5 Receptacle space
6 Filter chamber
7 Feed device
8 Chamber side
9 Guiding device
10 Driving device
11 Air flow channel
12 Station fan
13 Pressure sensor
14 Suction nozzle
15 Fan
16 Electric motor
17 Displacement device
18 Housing
19 Filter bag
20 Collection container access
21 Closure element
22 Connecting element
23 Station housing
24 Cleaning element
25 Wheel
26 Filter element
27 Closure element
28 Filter chamber opening
29 Limit stop
30 Spring element
31 Guiding device
32 Filter chamber closure element

What is claimed is:

1. A vacuumed material collection station for receiving vacuumed material from a vacuum cleaning apparatus, comprising:

a housing;

a vacuumed material collection container disposed in the housing;

an interface configured for connecting the vacuum cleaning apparatus to the vacuumed material collection station;

a receptacle space disposed in the housing and being configured for receiving a filter chamber of the vacuum cleaning apparatus connected to the vacuumed material collection station, and a feed device configured for feeding the filter chamber into the receptacle space, wherein the receptacle space is designed for completely encompassing the filter chamber or at the most not encompassing a chamber side facing the interface with the vacuum cleaning apparatus, wherein the receptacle space forms a partial volume within the housing of the vacuumed material collection station, wherein the feed device is designed for removing the filter chamber from the vacuum cleaning apparatus and displacing the filter chamber into the receptacle space, and wherein the vacuumed material collection container is configured for receiving vacuumed material from the filter chamber that is located in the receptacle space.

2. The vacuumed material collection station according to claim 1, wherein the feed device comprises a guiding device configured for guiding a displacement motion of the filter chamber into the receptacle space or a driving device configured for displacing the filter chamber.

3. The vacuumed material collection station according to claim 2, wherein the guiding device comprises a slotted guide or a guide rail or a guide spindle.

4. The vacuumed material collection station according to claim 1, wherein the receptacle space is arranged above the vacuumed material collection container in an operative orientation of the vacuumed material collection station such that vacuumed material can drop from a filter chamber arranged in the receptacle space into the vacuumed material collection container under the influence of gravitational force.

5. The vacuumed material collection station according to claim 1, wherein the receptacle space is arranged in an air flow channel of the vacuumed material collection station.

6. The vacuumed material collection station according to claim 5, further comprising a station fan designed for generating a vacuum in the receptacle space, the station fan being associated with the air flow channel.

7. The vacuumed material collection station according to claim 5, wherein the air flow channel comprises pressure sensors arranged upstream and downstream of the receptacle space relative to a flow direction.

8. A system consisting of a vacuumed material collection station according to claim 1 and a vacuum cleaning apparatus with a housing, a suction nozzle, a filter chamber, a fan and an electric motor for driving the fan, wherein the feed device of the vacuumed material collection station is designed for removing the filter chamber from the vacuum cleaning apparatus and displacing the filter chamber into the receptacle space, or wherein the vacuum cleaning apparatus comprises a displacement device that is designed for displacing the filter chamber out of the housing of the vacuum cleaning apparatus, wherein the vacuum cleaning apparatus is configured to be arranged on the interface of the vacuumed material collection station in such a way that the receptacle space of the vacuumed material collection station and a portion of the vacuum cleaning apparatus containing the filter chamber are connected to one another.

* * * * *